United States Patent [19]

Law et al.

[11] 4,145,983

[45] Mar. 27, 1979

[54] FEED REGULATING MECHANISM FOR A SEWING MACHINE

[75] Inventors: Joseph P. Law, Scotch Plains; Alfred R. Mack, Bayonne, both of N.J.

[73] Assignee: The Singer Company, New York, N.Y.

[21] Appl. No.: 919,028

[22] Filed: Jun. 26, 1978

[51] Int. Cl.[2] ..... D05B 27/22

[52] U.S. Cl. ..... 112/210

[58] Field of Search ..... 112/210, 203, 215, 208, 112/209

[56] References Cited

U.S. PATENT DOCUMENTS

| | | | |
|---|---|---|---|
| 3,149,592 | 9/1964 | Casas-Robert | 112/210 |
| 3,834,334 | 9/1974 | Adams et al. | 112/210 |
| 3,949,691 | 4/1976 | Adams | 112/210 |

FOREIGN PATENT DOCUMENTS

| | | | |
|---|---|---|---|
| 40626 | 12/1972 | Japan | 112/210 |
| 19345 | 3/1973 | Japan | 112/210 |
| 98851 | 8/1974 | Japan | 112/210 |

*Primary Examiner*—H. Hampton Hunter

*Attorney, Agent, or Firm*—William V. Ebs; Robert E. Smith; Edward L. Bell

[57] ABSTRACT

A modular feed regulating stitch length and reverse feed selector, and a modular assembly including feed regulating control linkages and a plastic support therefor are provided for use in a sewing machine. Each module is readily assembled apart from the machine and may thereafter be affixed for cooperative interrelationship in the machine bed.

5 Claims, 2 Drawing Figures

FEED REGULATING MECHANISM FOR A SEWING MACHINE

BACKGROUND OF THE INVENTION

1. Field of the Invention

The invention relates to feed regulating mechanisms for sewing machines and especially to feed regulating mechanisms, the operation of which may be both cam controlled and manually controlled.

2. Description of the Prior Art

Sewing machines are commonly provided with feed regulating systems which are manually controllable and cam controllable as in the manner shown, for example, in U.S. Pat. No. 3,834,334 issued Sept. 10, 1974, and assigned to The Singer Company. Linkage and camming arrangements which have been provided in such systems to respond either to manually initiated movements or cam controlling movements and produce output movements effective to control the position of a feed regulating shaft have, however, been unduly complex and difficult to assemble in a machine.

It is a prime object of this invention to provide an improved linkage and camming arrangement for controlling the position of a feed regulating shaft. More particularly, it is an object of the invention to provide such a linkage and camming arrangement which can be readily constructed from relatively few pieces apart from a sewing machine and thereafter affixed in the machine bed.

SUMMARY OF THE INVENTION

In accordance with the invention, there is provided for use in the feed regulating system of a sewing machine, an improved linkage arrangement responsive to patterning cam controlling movements or manually operable selector movements, and a support for such linkage arrangement, which linkage arrangement and support can be readily assembled before being affixed in the machine bed. Further, there is provided an improved manually operable stitch length and reverse feed selector module which also can be readily assembled apart from the machine and which, when affixed in the machine, interrelates with the said linkage arrangement in a novel manner rendering possible the use of a small number of simply structured parts in the linkage arrangement.

DETAILED DESCRIPTION OF THE INVENTION

Figure 2:
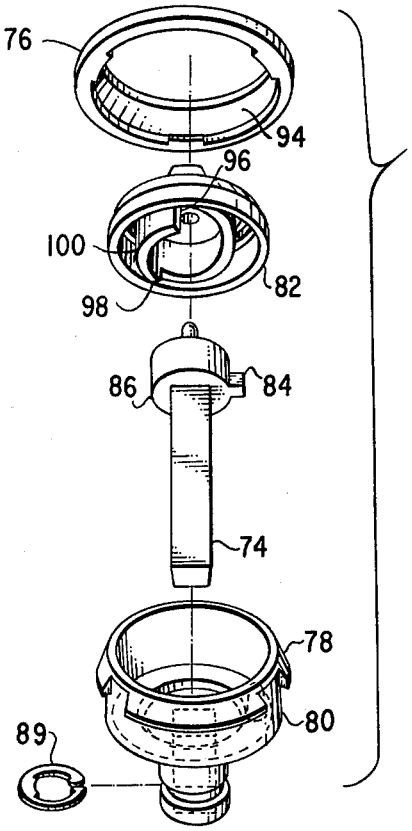
FIG. 2 is an exploded perspective view showing a manually operable stitch length and reverse feed selector constructed according to the invention.
Figure 1:
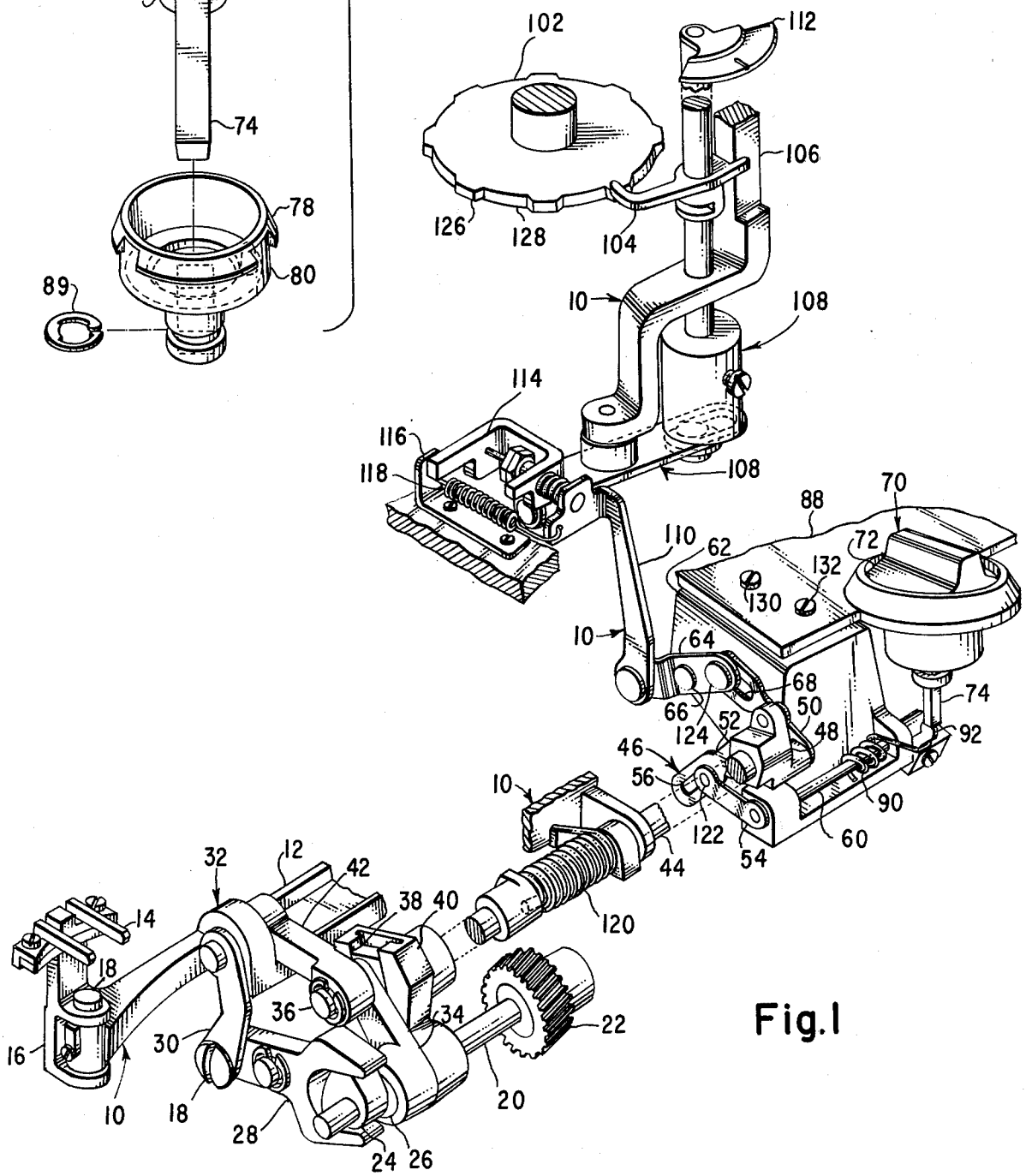
FIG. 1 is a perspective view showing sewing machine feed regulating mechanism according to the invention.

Referring to FIGS. 1 and 2 of the accompanying drawings, there may be seen a work feed control system for a sewing machine indicated generally by reference numeral 10. As is known, for example from U.S. Pat. No. 3,527,183, such a system includes a feed bar 12 mounted in the bed portion of the machine in a manner (not shown) such that it may be oscillated in mutually perpendicular directions so as to impart to a feed dog 14 substantially vertical and horizontal motion. The feed dog is carried by a bracket 16 which is secured to a pivot pin 18 journalled in the feed bar. A bed shaft 20 is journalled in the bed of the machine and is provided with a bevel gear 22 adapted to be driven in synchronism with the needle actuating mechanism of the machine. Affixed to the bed shaft is a lift cam 24, preferably of the triangular or constant breadth type, and a feed advance eccentric 26. The lift cam imparts vertical motion to the feed bar through bifurcated lever 28, link 30 and a pin and block assembly indicated generally by reference numeral 32. Transverse feed motion is imparted to the feed bar by means of the feed advance eccentric 26, pitman 34, pivot pin 36, slide block 38, feed regulator block 40 and link 42. A vertical position of the feed regulator block results in zero feed, whereas a counterclockwise position relative thereto results in forward feed and a clockwise position results in reverse feed. The aforesaid U.S. Pat. No. 3,527,183 should be referred to for a more detailed discussion of the interrelationship of these elements.

A feed regulator shaft 44 is mounted in the frame of the machine, preferably in the bed thereof, and carries feed regulating block 40 adjacent one end thereof. A lever assembly 46 is connected to the other end of the regulator shaft. Such lever assembly 46 includes a head 48 which is affixed to the end of the regulator shaft remote from the regulator block; links 50 and 52 each of which is pivotally connected at one end to head 48; a link 54 slidably connected at one end in a slot 56 in link 52 and affixed at the other end to a shaft 60 which pivots in a fixed plastic support 62; and a link 64 pivotally connected at an intermediate location 66 to support 62, and slidably connected at one end in a slot 68 in link 50. The other end of link 64 is operably connected with cam controlled feed mode mechanism and balancing mechanism hereinafter described.

A selector module 70 is provided adjacent plastic support 62. Such module 70 includes a dial 72 operatively associated with the lever assembly 46, a shaft 74 and housing members 76, 78 and 80. Dial 72 includes a cam 82 which is engaged by a cam follower 84 on a boss 86 that is secured to the shaft 74. The selector housings are held as an assembly in the machine frame 88 by a snap ring 89 and are prevented from rotating as by a key and slot arrangement (not shown). A spring 90 having one end in engagement with support 62 and the other end in engagement with a link 92 which is affixed to shaft 60 causes the link to act upwardly upon shaft 74 and the shaft to urge dial 72 into a position against concave inside surface 94 of housing member 76. The dial 72 may be turned into any selected position between limiting points defined by the engagement of the ends 96 and 98 of a sector 100 with the sides of cam follower 84, and when so turned, shaft 74 and link 92 move up or down depending upon the direction in which the dial is turned. The dial may also be depressed to cause shaft 74 to move link 92 into an extreme position.

At least one cam 102 is provided for use in controlling feed. Such cam is rotatably mounted in the machine and is associated with a cam follower 104 that may be engaged with or disengaged from the cam 102 by mechanism which, although not shown in the drawings, may be of the type shown and described, for example, in U.S. Pat. No. 3,795,210 of The Singer Company. As illustrated in FIG. 1, cam follower 104 is disengaged from cam 102 and the cam has no effect on feed. When, however, the cam follower 104 is engaged, it transmits cam initiated motion controlling feed mode through a torque bar 106, eccentric balance mechanism generally indicated at 108, and link 110 to lever assembly 46. A segment 112 of a control dial for the eccentric balance mechanism is shown, and it will be understood that rotation of the dial 112 effectuates a corresponding angular movement of the eccentric balance along with a shifting of bracket 114 and lever 110. The balancing mechanism is employed, as is known, to balance forward and reverse feed in the cam feed mode as required to compensate, for example, for differences in the frictional resistance of certain materials depending upon the direction of feed.

As already noted, the cam follower 104 is shown disengaged from cam 102 in FIG. 1. In such position, the cam 102 is ineffective, bracket 114 is held in contact with fixed member 116 by the action of spring 118 and link 110 is disposed as indicated. Shaft 44 is biased counterclockwise as viewed in FIG. 1 by a spring 120 causing the shaft feed regulator block 40, and the links 50 and 52 to assume positions defined by the engagement of a pin 122 in link 54 with the upper end of slot 56 in link 52. Such positions of shaft 44, feed regulator block 40 and links 50 and 52 depend upon the disposition of links 54 and 92 as determined by the angular setting of dial 72, and are shown in positions which correspond to a maximum stitch length setting of the dial resulting in movements of feed dog 14 effective to advance material being sewn in steps of maximum length in the forward feeding direction. Stitch length is shortened by turning the dial 72 to a new position causing shaft 74 to reposition links 92 and 54, and the link 54 acting through link 52 and head 48 to turn shaft 44 clockwise and so reposition regulator block 40. As the head 48 is moved to turn shaft 44, link 50 slides part way on pin 124 in slot 68 and does not produce movement of connected link 64. Feed reversal is manually effected by depressing the dial 72 to cause link 54 acting through the link 52 and head 48 to rotate the shaft 44 and feed regulator block 40 clockwise to an extreme position defined by the engagement of pin 124 with the lower end of slot 68 in link 50.

When the cam follower 104 is caused to engage cam 102, feed regulator block 40 is moved to control the operation of feed dog 14 in accordance with the peripheral outline of the cam. As shown, the cam 102 is provided with low and high camming surfaces 126 and 128 respectively resulting in forward and reverse feed movements respectively of the feed dog 14. Of course, the cam could also be provided with camming surfaces of intermediate height resulting in zero feed at times. The cam follower 104 when engaged is held against cam 102 by an action of the spring 118, and as the cam follower is moved to a high camming surface 126 during rotation of cam 102, motion is transmitted through torque bar 106, eccentric balance mechanism 108 and link 110 to link 64 which pivots on pin 66 and acts through link 50 on head 48 causing shaft 44 and feed regulator block to be moved clockwise into a position resulting in reverse feed. When, however, the cam follower moves to a low camming surface 128, link 110 is moved by spring 118 in a direction causing pin 124 to slide forward in slot 68 of link 50, whereupon spring 120 moves shaft 44 and feed regulator block 40 into a forward feed position defined by a reengagement of the end of slot 68 with pin 124 effective to terminate movement of link 50 by head 48 in response to the shaft rotation.

The selector module is easily assembled apart from the machine, and thereafter affixed to the machine bed. The plastic support 62, lever assembly 48, shaft 60 and link 92 are also readily assembled apart from the machine and then attached to the machine bed by screws 130 and 132.

The invention has been described herein in its preferred form however it is to be understood that the words which have been used are words of description rather than limitation and that changes within the purview of the appended claims may be made without departing from the spirit and scope of the invention.

Having thus set forth the nature of the invention, what is claimed herein is:

1. In a sewing machine feed regulating system, the combination comprising a feed dog, a feed regulating shaft disposable in different positions for controlling operation of the feed dog, a manually operable stitch length and reverse feed selector having an output shaft movable into different positions for prescribing different stitch lengths or reverse feed, a patterning feed controlling cam, a module including a support structure and a linkage assembly pivoted thereon, said linkage assembly being operably connected with the pattern controlling cam and the stitch length selector output shaft, and such linkage assembly being effective to impart control movements to the feed regulating shaft in response to operation of the stitch length selector or the pattern controlling cam.

2. The combination of claim 1, wherein said stitch length and reverse feed selector includes an internal cam turnable into different positions, and a cam follower for moving the selector shaft into different stitch length controlling positions.

3. The combination of claim 2, wherein the stitch length and reverse feed selector includes a rotatable dial for turning the internal cam, said dial also being axially movable for disposing the selector shaft in a reverse feed controlling position.

4. The combination of claim 1, including a shaft rotatably mounted on said support and having one end connected to the linkage assembly, a link connected to the other end of the shaft, and spring means biasing said link into contact with the shaft of the stitch length and reverse feed selector.

5. The combination of claim 1, wherein the linkage assembly includes a first link pivotally connected to the support structure and responsive to operation of the patterning feed controlling cam, a second link also pivotable on said structure and responsive to movements of the shaft of the stitch length and reverse feed selector, a lost-motion link connected to said first link, another lost-motion link connected to said second link, and a member connected to both said lost-motion links and the feed regulating shaft.

* * * * *